US008104697B2

(12) United States Patent
Petrovic

(10) Patent No.: US 8,104,697 B2
(45) Date of Patent: Jan. 31, 2012

(54) FLUID SPRAY CONTROL DEVICE

(76) Inventor: John E. Petrovic, Fort Collins, CO (US)

( * ) Notice: Subject to any disclaimer, the term of this patent is extended or adjusted under 35 U.S.C. 154(b) by 100 days.

(21) Appl. No.: 12/402,548

(22) Filed: Mar. 12, 2009

(65) Prior Publication Data

US 2009/0236438 A1 Sep. 24, 2009

Related U.S. Application Data

(60) Provisional application No. 61/069,879, filed on Mar. 19, 2008.

(51) Int. Cl.
*B05B 1/34* (2006.01)
*B05B 15/08* (2006.01)

(52) U.S. Cl. ..... 239/472; 239/396; 239/403; 239/463

(58) Field of Classification Search ..... 239/390, 239/391, 396–399, 402, 402.5, 403, 405, 239/429, 430, 432, 433, 463, 472
See application file for complete search history.

(56) References Cited

U.S. PATENT DOCUMENTS 1,508,281 A * 9/1924 Kelly ..... 239/472
2,027,954 A * 1/1936 Barclay ..... 239/472
3,691,584 A 9/1972 Landers
3,776,460 A 12/1973 Fichter
4,026,470 A 5/1977 Crist
4,346,844 A 8/1982 Harmony
4,394,965 A 7/1983 Backe et al.
4,669,667 A * 6/1987 Perkins et al. ..... 239/467
4,962,886 A 10/1990 Stockel
5,060,867 A 10/1991 Luxton et al.
5,344,080 A 9/1994 Matsui
5,507,436 A 4/1996 Ruttenberg
5,577,664 A 11/1996 Heitzman
6,561,440 B1 * 5/2003 Hofherr ..... 239/472
6,722,586 B2 4/2004 Bonse et al.
6,805,164 B2 10/2004 Stouffer
7,111,800 B2 9/2006 Berning et al.
7,278,591 B2 10/2007 Clearman et al.
2005/0000581 A1 1/2005 Lane et al.
2005/0061896 A1 3/2005 Luettgen et al.
2005/0263617 A1 12/2005 Thong
2006/0219821 A1 10/2006 Okuma

* cited by examiner

*Primary Examiner* — Darren W Gorman
(74) *Attorney, Agent, or Firm* — Paul M. Thompson; Cochran Freund & Young LLC

(57) ABSTRACT

Disclosed is a method and device for fluid handling relating to controlling and directing the water streams from spray devices utilizing multiple liquid streams to produce an effluent that enhances a user's perception of spray performance. In the disclosed embodiments, a cavity acts as a mixing chamber for multiple fluid jets that enter the cavity at various locations, angles and flow rates. By positioning these inlet ports in the upper portion of the cavity, and with the ability to precisely direct and meter the fluid flow, the spray device may achieve a multitude of flow patterns from an outlet.

12 Claims, 9 Drawing Sheets

COHERENT JET

TRAJECTORY CONTROL

OSCILLATING JET

SWIRLING JET

MASSAGING JET

FULL CONE SPRAY

HOLLOW CONE SPRAY

FLUID SPRAY CONTROL DEVICE

CROSS REFERENCE TO RELATED APPLICATION

This application is based upon and claims the benefit of U.S. provisional application No. 61/069,879, entitled "FLUID SPRAY CONTROL DEVICE", filed Mar. 19, 2008, the entire disclosure of which is hereby specifically incorporated by reference for all that it discloses and teaches.

BACKGROUND OF THE INVENTION

Spray heads for directing liquid flows are used in a host of commercial devices such as showerheads, sprinklers, faucets, body spray heads, etc. Most devices using water for spray purposes are constrained regarding the flow rates that are permissible with such devices. With increasing populations and dwindling supplies of fresh water, allowable usage flow rates are expected to continue to decrease and tighter restrictions and regulations are likely to occur. With increasing restrictions limiting the volume of water being used, it is desirable to optimize characteristics to enhance a user's perception of spray performance.

SUMMARY OF THE INVENTION

An embodiment of the present invention may therefore comprise: a fluid spray control device that produces a variety of fluid spray patterns comprising: a housing that forms an enclosed flow path interface between a pressurized fluid source and at least one substantially cylindrical mixing cavity, the mixing cavity having a cylindrical axis and a length which is greater than diameter; a manifold within the housing that divides the fluid into at least two fluid streams that flow to at least one mixing cavity; a central flow port and at least one lateral flow port positioned on a proximal end of at least one mixing cavity, the central flow port that jets a first portion of the divided fluid into the mixing cavity at a trajectory substantially parallel to the cylindrical axis, and at least one lateral flow port that jets a second portion of the divided fluid into the mixing cavity at a substantially tangential trajectory to the cylindrical axis; a cavity outlet orifice positioned approximately on the cylindrical axis of the mixing cavity that dispenses a mixture of the first portion of the fluid and the second portion of the fluid in a flow pattern which is defined by the ratio of the first fluid introduced to the mixing cavity to the second fluid introduced to the mixing cavity, the cavity outlet orifice having an opening which is less than the mixing cavity diameter; and, a reducing section within the mixing cavity that transitions the diameter of the mixing cavity to the diameter of the cavity outlet orifice.

An embodiment of the present invention may also comprise: introducing a first fluid under pressure to at least one central flow port on a proximal end of a substantially cylindrical mixing cavity, the mixing cavity having a cylindrical axis and a length which is greater than diameter; jetting the first fluid in a substantially parallel trajectory to the cylindrical axis into the mixing cavity; introducing a second fluid under pressure to at least one lateral flow port on a proximal end of the mixing cavity; jetting the second fluid in a substantially tangential trajectory to the cylindrical axis into the mixing cavity; mixing the flow of the first fluid with the second fluid along a length of the mixing cavity; concentrating the flow of the mixed fluid in a section of the mixing chamber where the diameter is reduced; and, dispensing the reduced mixed fluid from the jet orifice located approximately on the cylindrical axis at a distal end of the mixing cavity; varying the pattern of dispensed mixed fluid by regulating the ratio of the first fluid introduced to the mixing cavity to the second fluid introduced to the mixing cavity.

DETAILED DESCRIPTION OF THE INVENTION

Figure 1:
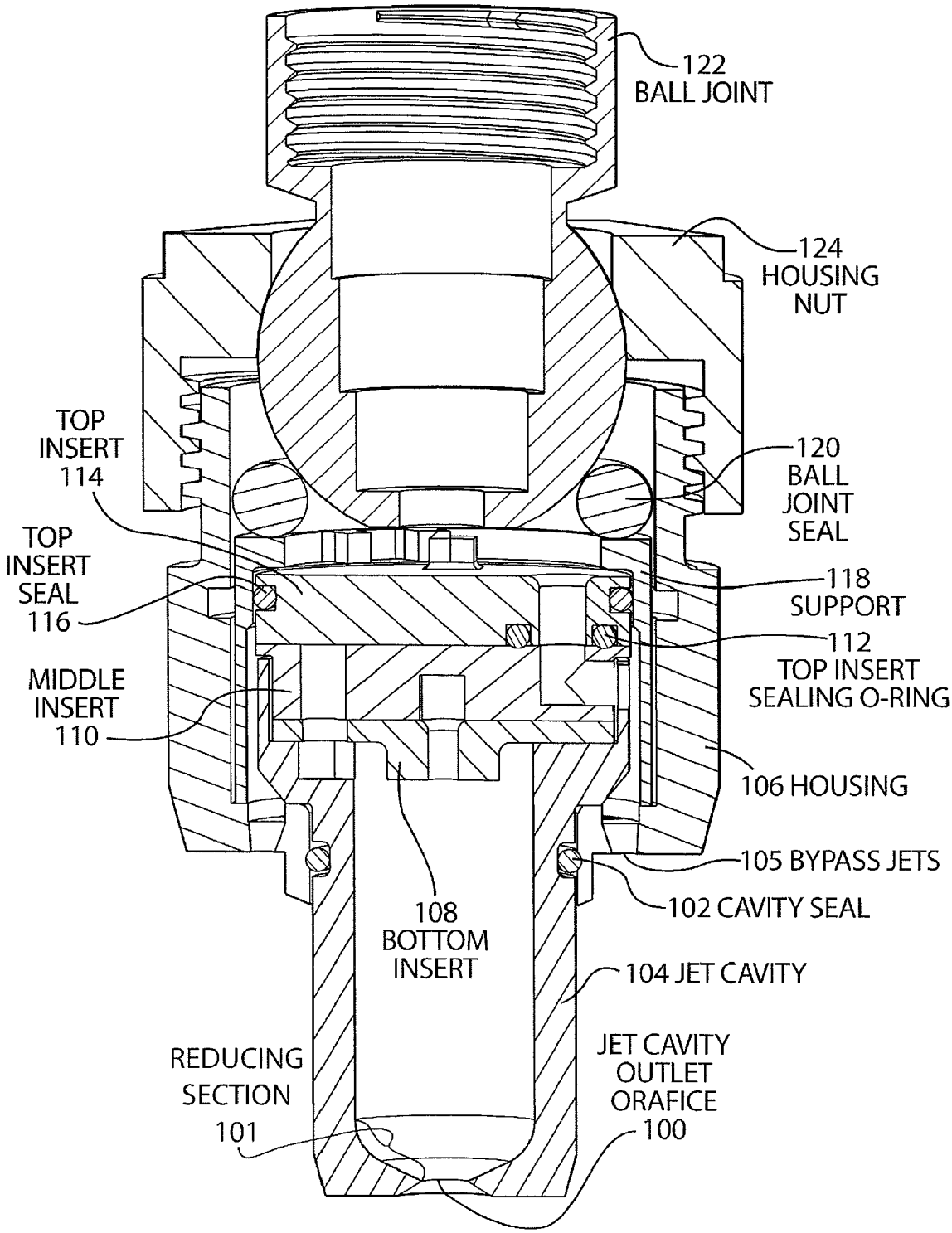
FIG. 1 illustrates a cross sectional view of an embodiment of a fixed-angle, single-cavity geometry fluid spray control device.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described.

FIG. 1 illustrates a cross sectional view of an embodiment of a fixed-angle, single-cavity geometry fluid spray control device. This particular embodiment utilizes a single jet cavity 104 to direct liquid flow in a showerhead/body spray head application. As with most devices using water for showering purposes, this device allows flow rates less than 2.5 gallons per minute while delivering performance characteristics which are perceived by the user as a much higher flow rate. These performance characteristics include; the volume of water being used, the typical size of droplets in the sprays, the velocity with which the water droplets strike the user, the area over which the droplets strike, and the frequency with which droplets strike the user's surface.

In the disclosed embodiment, droplet size can be varied significantly depending upon the geometry of the spray head as well as the operating pressure. It is generally believed that there is a range of droplet sizes that influence a user's perception as to the volume of water being delivered. While a given volume of water can be dispersed into a larger number of smaller droplets, these smaller droplets generally feel like a smaller quantity of water when they impact against a user's skin. When larger droplets strike a user, partly because of their size, they often create the effect of a greater volume of water being used. Droplets in the size range between 1.5 to 3 mm in diameter create an acceptable perception of water volume. While this size range is adequate to create an acceptable feel when striking a user, it is still small enough to produce large numbers of droplets at typical water flow rates. For a flow rate of 2.0 gallons per minute, approximately 40,000 of these droplets per second can be created with the disclosed embodiments. With the disclosed spray device, many of these droplets are directed to impact upon the user, helping to create the perception of a large water flow.

The embodiment of FIG. 1 produces a large pattern for the impinging droplets so as to not impact the user in the same or nearly the same spot which can produce a stinging or numbing sensation on the user. This is accomplished by controlling each jet stream from each orifice so as to provide the precise droplet size, frequency and velocity.

By controlling the jets of water before they exit their respective orifices, the resulting streams can be made to travel in well defined and predictable trajectories thereby managing the distribution of the droplets over a wide variety of surface areas. In addition to the ability to control the droplet characteristics, the issuing jets may perform a variety of flow patterns, such as randomly oscillating jets, swirling jets with controllable swirl frequencies, extremely coherent jets, jets with full cone droplet distributions, jets with a conical sheet of droplets and the like. The manner in which these varied distributions are attained, depends upon how the fluid streams are introduced into the upstream jet cavity, as well as the geometrical characteristics of the selected cavities.

Since droplet size within the fluid spray is related to the size of the outlet orifice (jet cavity outlet orifice 100) through which the water is imparted, the fluid dynamics of water jets issuing from nozzles and breaking up into droplets produces four regimes with the phenomena of liquid jet breakup. These are generally referred to as the Rayleigh, first wind-induced, second-wind induced and the atomization regimes. These regimes are encountered as the velocity of the liquid jet is increased relative to the surrounding gas. In the first regime, the Rayleigh regime, the drop sizes are generally larger than the jet diameter as the inertial and surface tension forces are comparable. In the first wind-induced regime, as the velocity is increased, the inertial forces become larger, but the drop sizes are still of the same order as the jet diameter. As the velocity is increased further, the gas inertia becomes important and drop diameters less than the jet diameter are formed. Finally, in the atomization regime, very high inertial forces are encountered and the size of the resulting droplets is much smaller than the jet diameter. Most shower spray devices are operated in the second and third regimes. In both cases, the resulting droplet size is generally related to the jet (or jet cavity outlet orifice 100) diameter.

As illustrated in FIG. 1, a cutaway view of the apparatus shows a standard ball joint 122 which can thread onto a standard shower pipe (e.g., ½" NPT [National Pipe Thread—Tapered]). The ball joint 122 interfaces with the rest of the fluid spray control device by a ball joint seal 120 and a housing nut 124 that threads with the housing 106. Within the device, a support 118 circumferentially retains the control mechanisms which route flow. The top insert 114, middle insert 110 and bottom insert 108 are placed in communication with one another coaxially and change the flow patterns of the fluid passing through the device based upon their relative orientation to one another. This relative orientation is based upon the coaxial rotation of the parts through opening and closing particular flow routes within the device. The top insert 114 seals against the upper support 118 using top insert seal 116 and seats against the middle insert 110 with top insert seal 116. Middle insert 110 rests directly upon bottom insert 108 to vary the flow through the three insert parts thereby opening and closing flow paths to the lower portion of the device.

Figure 2:
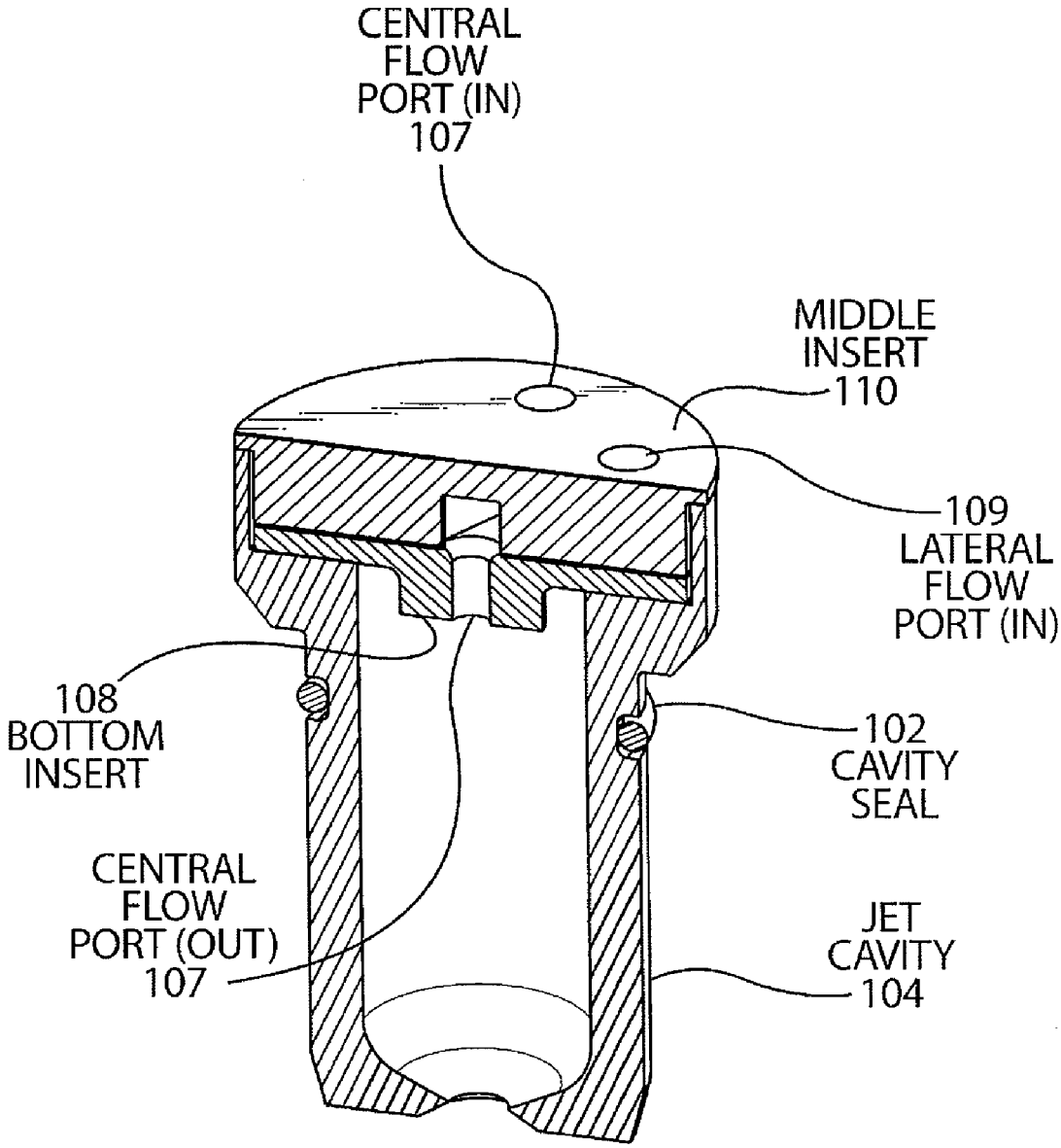
FIG. 2 illustrates a cross sectional view of an embodiment of a fixed-angle, jet cavity assembly for a fluid spray control device.
Figure 3:
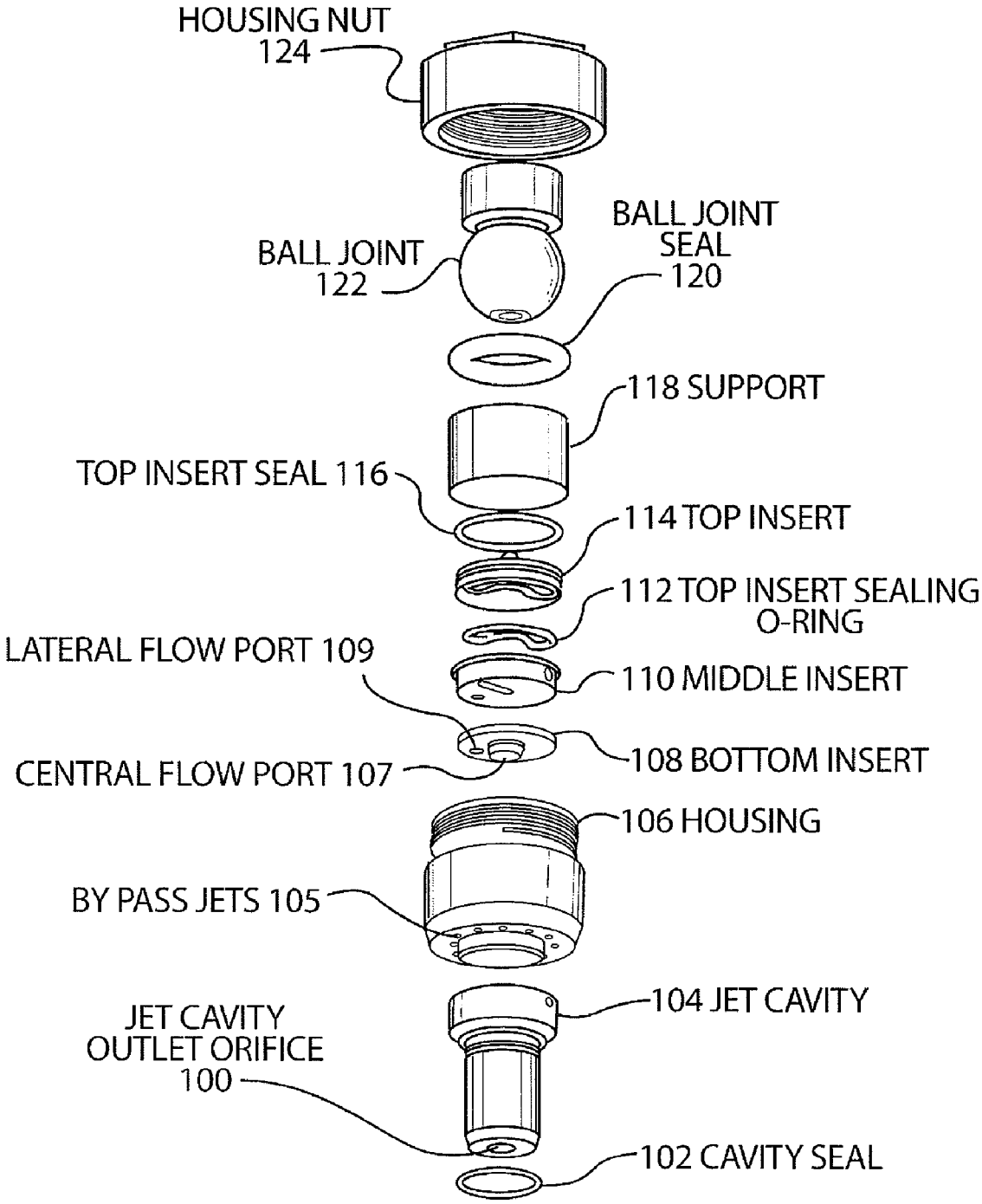
FIG. 3 illustrates an exploded view of an embodiment of a fixed-angle, single-cavity geometry fluid spray control device.

In this particular embodiment shown as FIGS. 1-3, the bottom insert 108 jets fluid through two outlet ports into jet cavity 104 which is retained within housing 106 and sealed by cavity seal 102. Jet cavity 104 receives flow from the bottom insert 108 via central flow port 107 and lateral flow port 109. Jet cavity 104 acts as a receptacle and mixing chamber for the two flow ports 107 and 109. Flows mix and are directed down the length of the mixing chamber to a reducing section 101. In this section the diameter of the mixing cavity is reduced over a short distance from the cavity diameter to the diameter of the jet cavity outlet orifice 100. This reducing section 101 allows the mixed flow to emanate from the orifice without introducing significant vertical turbulence into the mixing chamber 104 and produces a better spray pattern out of a single outlet that is located approximately on the cylindrical axis of the mixing chamber 104. Although FIG. 1 shows a single lateral flow port 109, two or more lateral flow ports may be used to increase the portion of fluid that is circulated through jet cavity 104, thus increasing the ratio of tangential flow to axial flow, and thereby changing the pattern of flow exiting the jet cavity outlet orifice 100. Typically, if two lateral flow ports 109 are utilized, they are typically placed diametrically in opposition with reference to the central flow port 107, and spaced at an equal distance from the center line of the bottom insert the 108.

This particular embodiment additionally allows for flow to be directed away from the jet cavity 104 to a series of bypass jets 105 which are located circumferentially around the outside of jet cavity 104, and exiting on the lower portion of housing 106. The bypass jets 105 allow for a conventional spray pattern such as might be found on a typical showerhead. These streams can be projected in a direction determined by the shape of the outlets and can be seen as separate and distinct fluid streams or jets. This mode may be used in conjunction with, or instead of the flow of through jet cavity 104.

In this embodiment, the manifold function of the device is comprised of the parts shown as the middle insert 110, the bottom insert 108, and the top insert 114 which serves as the control plate. In this example, the control plate, or top insert 114, is held in a stationary position relative to the shower housing and the jet cavity 104. The bottom insert 108 and the middle insert 110 can be rotated as one assembly and may be affixed within the device by any number of suitable means such as sonic welding, adhesive bonding, fixed keying features, etc. This relative motion of the manifold parts results in the fluid being proportioned to the various inlets, depending upon the rotational orientation of the top insert 114 to the middle insert 110.

It may also be desirable to include a secondary sealing member to control leakage that might occur between the manifold parts to other outlets. In this case, the top insert sealing O-ring 112 acts as this secondary sealing member to prevent leakage between the standard spray pattern outlets (bypass jets 105) and the spray pattern outlets produced by the jet cavity 104.

FIG. 2 illustrates a cross sectional view of an embodiment of a fixed-angle, jet cavity assembly for a fluid spray control device such as shown in FIG. 1. This view shows the jet cavity assembly which is rotated into position relative to the top insert 114. As mentioned previously, the jet cavity 104 receives fluid from a central flow port 107. It is also contemplated that multiple flow ports may be utilized and positioned coaxially to central flow port 107. In addition, one or more lateral flow ports 109 can be introduced into the jet cavity 104 and mix with the central flow. The large inner diameter and length of the jet cavity 104 provides for a mixing chamber for the trajectories of the combined flows. The relative position of the manifolds results in fluid being proportioned to the various inlets depending upon the rotational orientation of the top insert to the middle insert. This allows for great flexibility and precision in metering flow to the central and lateral flow jets thereby providing a wide variety of flow patterns from the spray control device.

The flow port inlets (107, 109) to the jet cavity 104 are generally characterized by an inlet diameter. Although it should be mentioned that while the diameter is often that of a circular orifice, the inlet shape need not be circular. Other shapes, such as a triangular, oval, elliptical, polygonal, conical and the like, may be used and have been shown to influence the stability and jetting characteristics of the inlets. Similarly, the shape of the jet cavity outlet orifice 100 may be structured with a variety of shapes such as mentioned above to deliver additional functionality and variability of the dispensed flow. The diameter of the jet cavity 104 into which the flows enter, in combination with the size, diameter, position and trajectory of the inlet jets, influences the flow performance of the spray device.

With regard to the central flow port 107 flowing into the cavity, the diameter of the mixing cavity 104 must be of sufficient size to allow a re-circulation region adjacent to the jet and to allow the jet to bend toward the inner wall of the jet cavity 104. The cavity length should be sufficient to allow the central jet to contact or attach to the cavity wall thereby allowing additional influences of the Coanda Effect to shape the flow of the fluid. The jet cavity 104 length is related to the inlet size of the center flow port 107 and the cavity diameter. It has been found by experiment that generally jet cavity lengths between 1.5 and 3 times the jet cavity diameter have provided better performance. The geometry leading up to the jet cavity outlet orifice 100 also influences the overall performance of the spray device. The size of the jet cavity outlet orifice 100, generally measured by an outlet diameter, has been shown to provide better spray performance when this diameter is in a range that is nearly equal to the center flow port 107 diameter or is about three times this diameter.

The jet cavity 104, therefore acts as a mixing chamber for various fluid jets that enter the cavity at various locations, angles and flow rates. By positioning these inlet ports in the upper portion of the jet cavity 104, and with the ability to precisely direct and meter the fluid flow, the spray device may achieve a multitude of flow patterns that emanate from a single jet cavity outlet orifice 100.

FIG. 3 illustrates an exploded view of an embodiment of a fixed-angle, single-cavity geometry fluid spray control device. This view illustrates the interface and assemblies of the various components which make up the embodiments detailed in FIG. 1.

Figure 4:
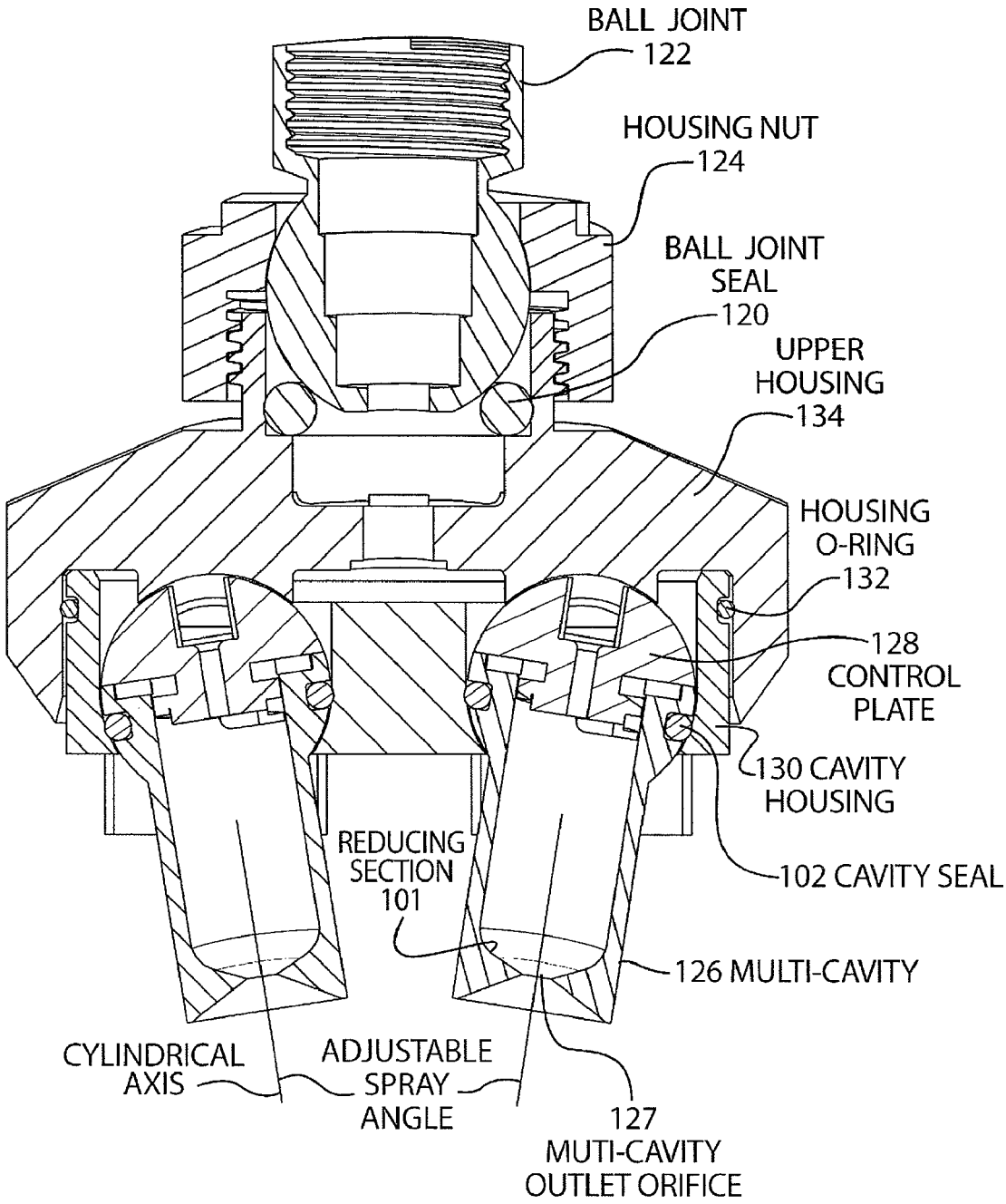
FIG. 4 illustrates a cross sectional view of an embodiment of a variable-angle, dual-cavity geometry fluid spray control device.

FIG. 4 illustrates a cross sectional view of an embodiment of a variable-angle, dual-cavity geometry fluid spray control device. As detailed in FIG. 4, the disclosed embodiment incorporates a second jet cavity (multi-cavity 126) within the spray control device. In a manner which is similar to the embodiment of FIGS. 1-3, a ball joint 122 threads to a standard shower fitting and is retained to an upper housing 134 with a threaded ball nut 124 and sealed with a ball joint seal 120. The upper housing 134 distributes the flow into two streams which each feed an independently controllable multi-cavity 126. The two multi-cavities 126 are held in place with a cavity housing 130 attached to the upper housing 134 and sealed with a housing O-ring 132. Each multi-cavity 126 is sealed in the cavity housing 130 with a cavity seal 102. The mechanical and flow interface between the housings 134 and 130 and the multi-cavity 126 is performed with a control plate 128 which defines the bounds of movement of each multi-cavity 126 and defines the flow jets that enter the cavity area.

In this embodiment, each of the multi-cavities 126 can be positioned to direct flow from the multi-cavity outlet orifice 127 in an independent manner from the other outlet. FIG. 4 illustrates a device consisting of two cavity controlled spray devices which can be individually oriented along the cylindrical axis so as to control the direction of the resulting spray patterns that exit from each cavity. The cavity control devices (control plates 128) shown in this embodiment consist of only two inlets for each cavity. One inlet is an inlet that is directed into the central portion of the cavity and the second inlet has its flow directed tangentially into the cavity. Options for individually directing the trajectory of the flows through the outlets by interaction of the inlet flows, as described previously, has been enhanced by a design to physically orient each cavity so that the outlet flow is oriented in a desired direction. FIG. 4 is shown with a converging spray angle which produces a converging spray. The embodiment also allows for diverging spray angles which deviate from one another and disburses the spray pattern. Additionally, it may be contemplated that a large number of multi-cavities 126 may be incorporated into an embodiment without diverging from the spirit of the invention.

Figure 5:
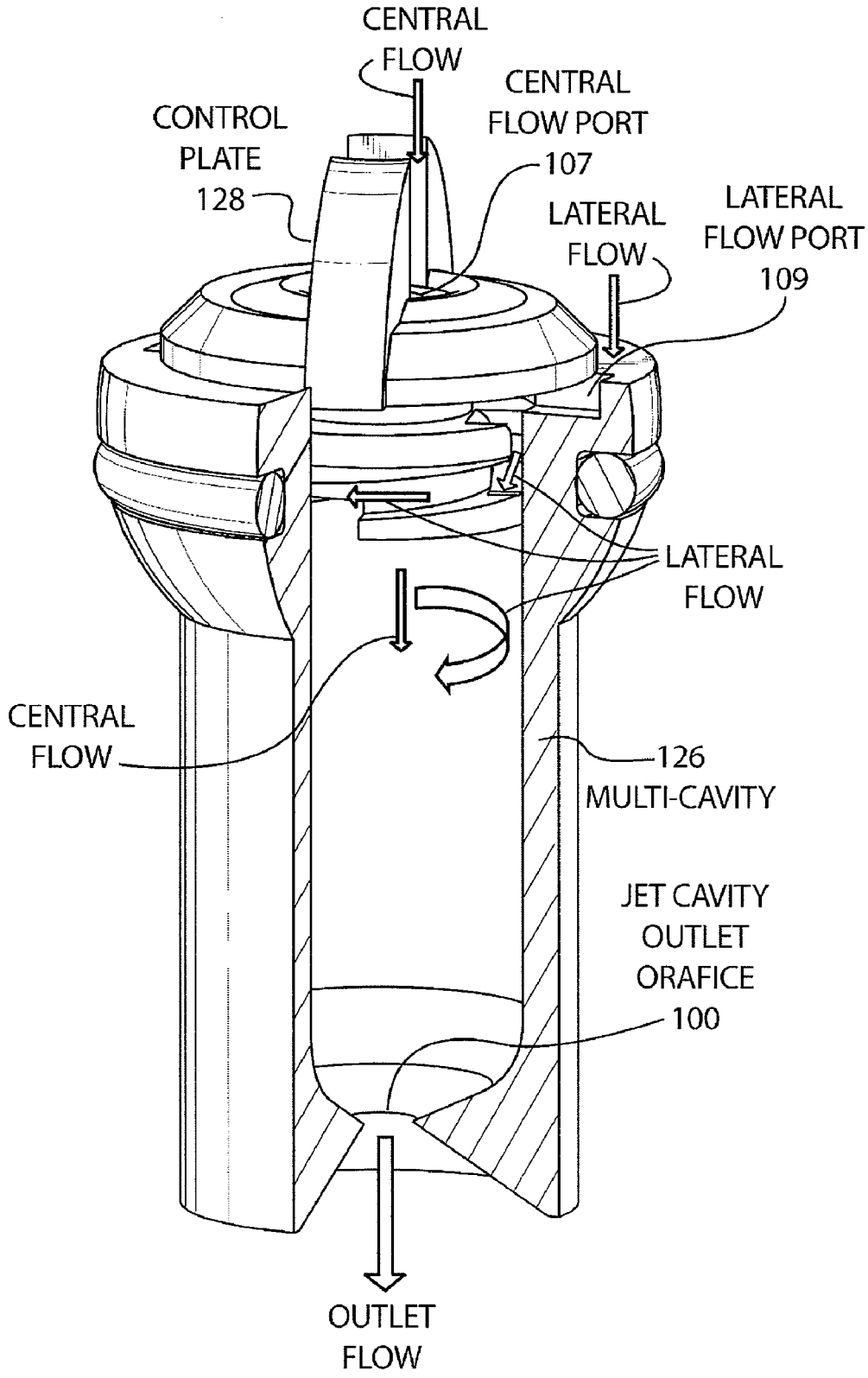
FIG. 5 illustrates a cross sectional view of an embodiment of a variable-angle, jet cavity assembly for a fluid spray control device.

FIG. 5 illustrates a cross sectional cutaway view of an embodiment of a variable-angle, jet cavity assembly for a fluid spray control device such as shown in FIG. 4. This view shows the variable trajectory multi-cavity 126 assembly which receives fluid from a central flow port 107 located on the control plate 128. In addition, one or more lateral flow ports 109 can be introduced into the multi-cavity 126 and mix with the central flow. Again, as with the cavity of FIG. 1, the large inner diameter and length of the multi-cavity 126 provides for a mixing chamber for the trajectories of the combined flows.

As mentioned in the previous embodiment, the flow port inlets (107, 109) to the multi-cavity 126 are generally characterized by an inlet diameter. These diameters into which the flows enter in combination with the length, position and trajectory of the inlet jets, similarly influence the flow performance of the spray device. As with the device of FIG. 1, the multi-cavity 126 acts as a mixing chamber for the fluid jets that enter the cavity at various locations, angles and flow rates. By positioning these inlet ports in the upper portion of the multi-cavity 126, and with the ability to precisely direct and meter the fluid flow, the spray device may achieve a multitude of flow patterns that emanate from each jet cavity outlet orifice 100.

The cutaway view of the spray control device shown in FIG. 5 shows the operation of controlling inlet flow to the inlet that directs the flow tangentially (lateral flow port 109). The control plate 128 has an outer edge that, through rotation, progressively blocks the inlet flow into the underside of the control plate top surface. Flow that does enter the control plate 128 in this region is directed to exit the control plate 128 in a tangential manner as shown. The inner body of the control plate 128 is fitted closely to the inner wall of the cavity surface so that flow leakage is minimal and nearly all control flow passes through the required channels. A small amount of leakage is not detrimental to the performance of this device, because this leakage flow will be swept up by the main flow occurring within the cavity.

In this embodiment, the control plate 128 is constrained so that its upper circular shaped rib is constrained to only allow the control plate 128 to rotate with the cavities around essentially a horizontal axis. The rib of the control plate translates through the rib guides that are present on the upper housing. In this manner, the control plate 128 remains fixed relative to the axial location of the multi-cavity 126. By controlling the flow plate in this way, the surface of the control plate 128 can remain in contact with the upper surface of the multi-cavity 126 so that the function of controlling the inlet flow is maintained. This then allows the multi-cavities 126 to be rotated about their center axis, relative to the control plate 128, which then controls the amount of fluid allowed to enter the top surface of the underside of the control plate 128 and be directed tangentially into the chamber of the multi-cavity 126. By controlling the tangential inlet flow in this manner, it is possible for the device to achieve a greater variety of flow patterns. Since each jet can be individually adjusted, and since it is possible for each jet cavity to exhibit multiple spray patterns, the combination of spray patterns from the device can be quite large.

The embodiment of FIG. 5 also shows a feature that controls the motion of the control plate 128. This design only allows the control plate 128 to rotate about a horizontal axis as it translates along the channel formed by the ribs in the upper housing 134. However, if the jet cavity were allowed to be able to rotate in a direction normal to this motion, this wedging action could result in increased separation between the control plate sidewall and the inner cavity wall. This could result in leakage that may be sufficiently large so as to disrupt the intended flow pattern. To prevent this condition from occurring, cavity guides can be added to the external housing such as shown in FIG. 5, so that motion of the jet cavities are constrained to be in the same direction as that of the control plates.

Figure 6:
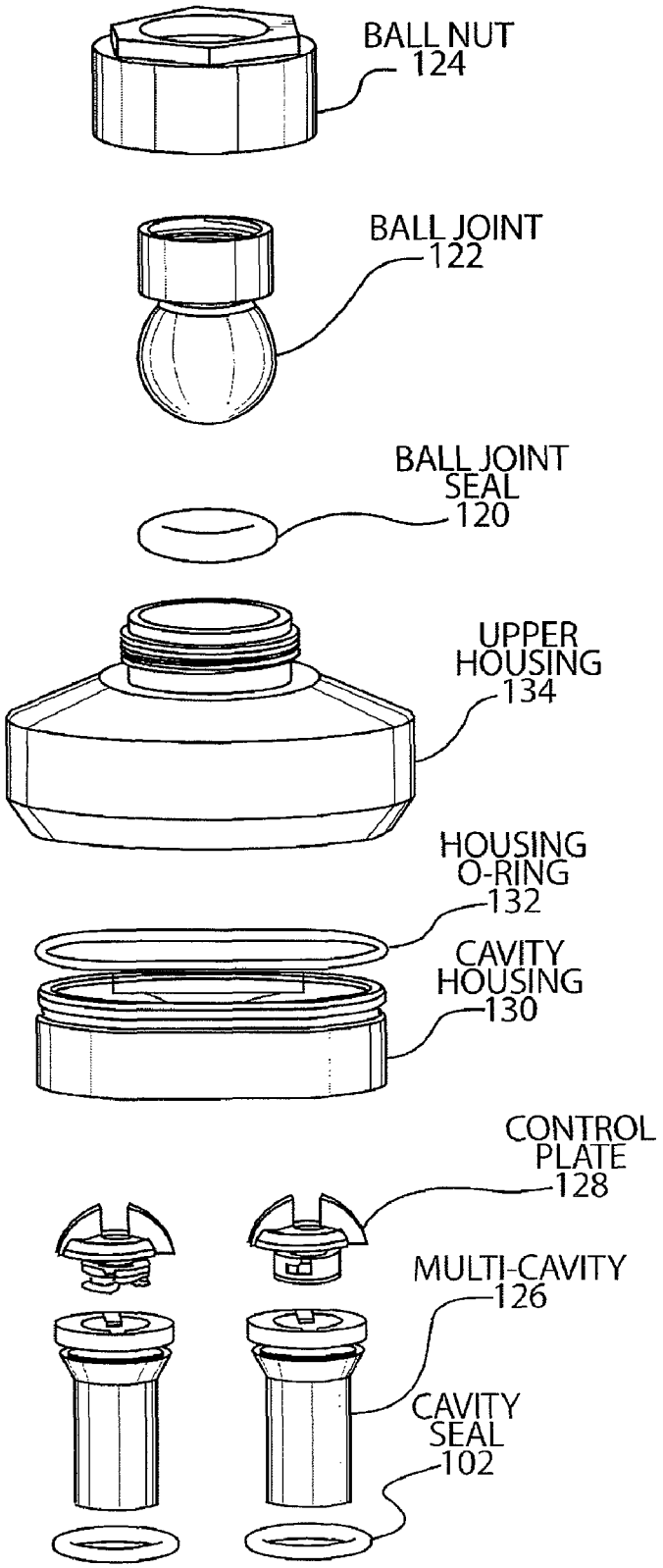
FIG. 6 illustrates an exploded view of an embodiment of a variable-angle, dual-cavity geometry fluid spray control device.

FIG. 6 illustrates an exploded view of an embodiment of a variable-angle, dual-cavity geometry fluid spray control device. This view illustrates the interface and assemblies of the various components which make up the embodiments detailed in FIG. 4.

Figure 7:
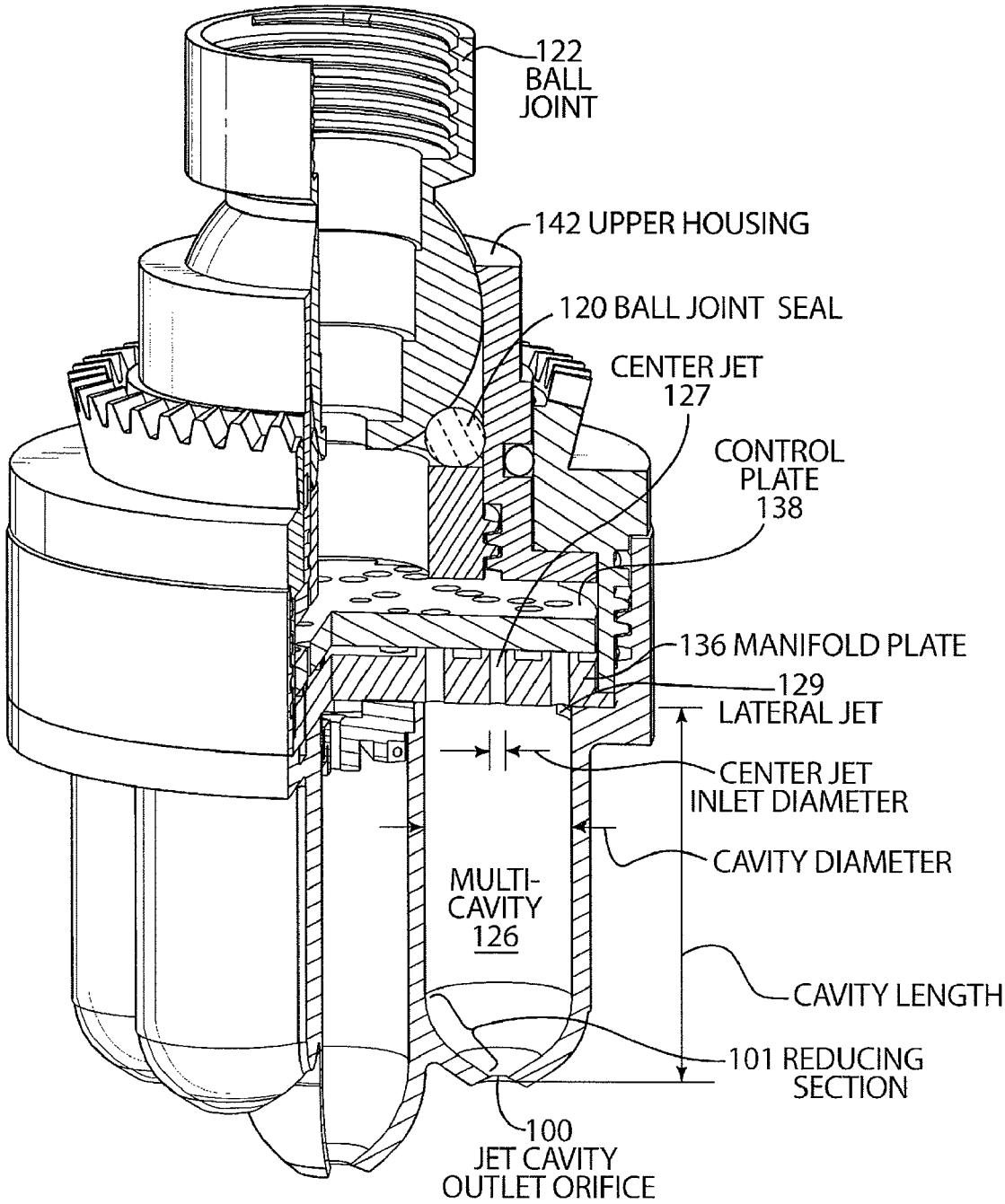
FIG. 7 illustrates a cross sectional view of an embodiment of a fixed-angle, multiple-cavity geometry fluid spray control device.

FIG. 7 illustrates a cross sectional cutaway view of an embodiment of a fixed-angle, multiple-cavity geometry fluid spray control device. In this embodiment, a fixed-position, single central jet cavity is immediately and symmetrically surrounded by a plurality (in this case 6) of fixed-position multi-cavities 126 thereby creating a 7 cavity spray head. This view shows each of the 7 cavities which receive fluid from a center jet 127 from an orifice located on a manifold plate 136. In addition, two lateral jets 129 can be introduced into each multi-cavity 126 and mix with the central flow. Again, as with the cavity of FIG. 1, the large inner diameter and length of the jet cavity provides for a mixing chamber for the trajectories of the combined flows.

In a similar manner to the previous embodiments, a ball joint 122 threads to a standard shower fitting and is retained to an upper housing 142 and sealed with a ball joint seal 120. The upper housing 142 distributes the flow to a control plate 134, which distributes the flow into a multitude of streams which interact with the manifold plate 136 to direct flow into the jet ports 127 and 129 of the multi-cavities 126. Thus, in one orientation of the control plate 134 to the manifold plate 136, the flow is directed nearly entirely to the center jets 127, where in another orientation, the flow is directed preferentially to the lateral jets 129. At orientations in between these extremes, flow is metered between center and lateral flow to provide a variety of flow patterns.

Figure 8:
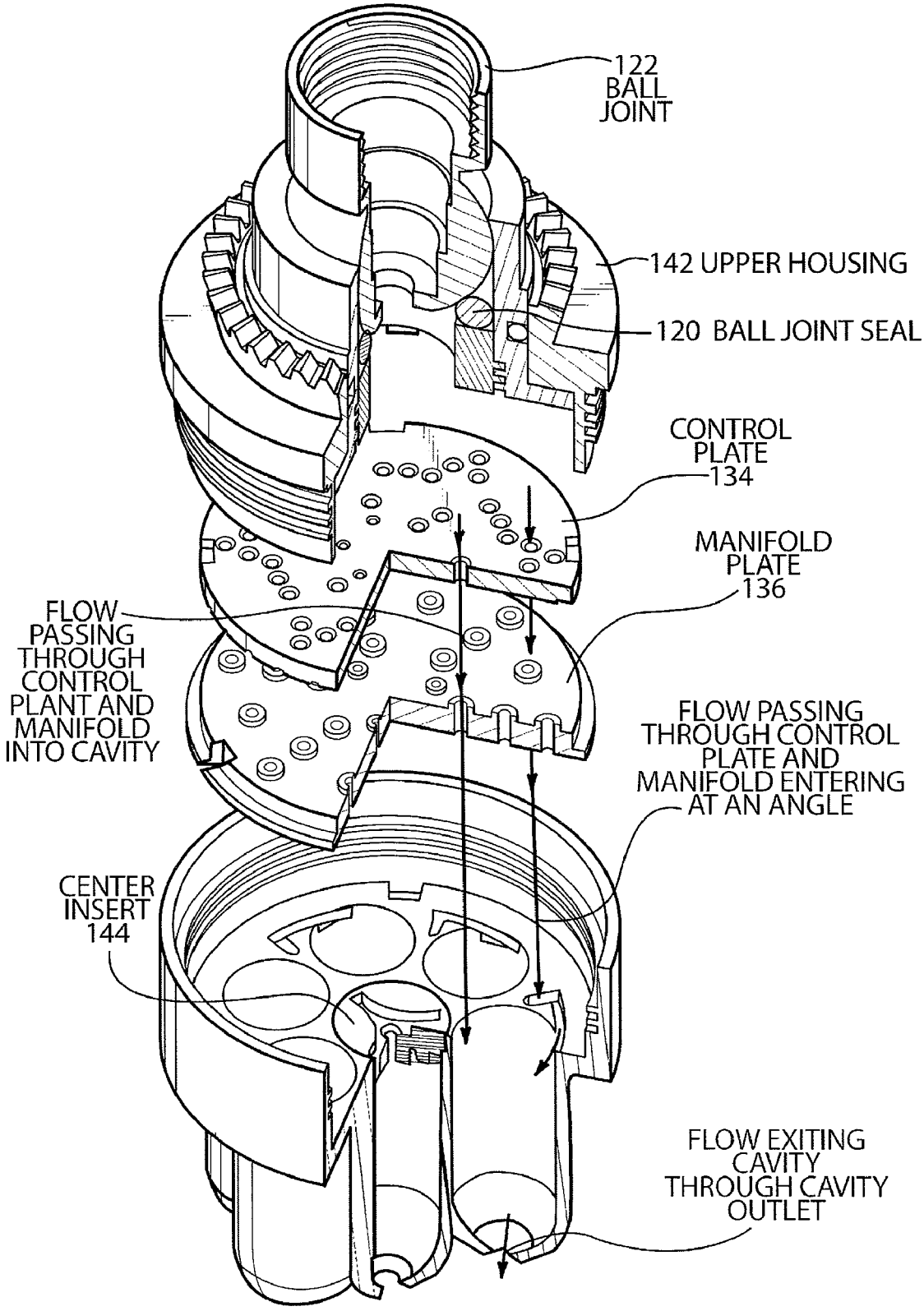
FIG. 8 illustrates an exploded view of an embodiment of a fixed-angle, multi-cavity fluid spray control device.

FIG. 8 illustrates an exploded view of an embodiment of a fixed-angle, multi-cavity fluid spray control device. This view illustrates the interface and assemblies of the various components which make up the embodiments detailed in FIG. 7. In this embodiment, the control plate 134 functions to distribute flow to the various orifices of the manifold plate 136 which function to control the location and direction of the fluid flow into the center insert and 144 and multi-cavities 126. For more simplified embodiments of this device, some of the functions of the manifold plate 136 can be accomplished by incorporating elements of this device directly into another part, such as the multi-cavity 126. In this case, there would be no separate manifold part. When manufacturing considerations or space constraints require, the manifold may consist of more than one piece as shown in the embodiment of FIG. 4. In this case, the parts comprising the manifold function are generally referred to as inserts.

As stated above, the function of the control plate 134 is to control the fluid flow to the flow ports in the part providing the functions of the manifold. Generally, the control plate will be designed such that the flow is regulated to certain flow ports so as to accomplish various spray patterns. Some of the spray patterns possible with this device are shown in FIG. 9. FIGS. 7 and 8 show the control plate 134 and manifold plate 136 in direct contact with no intermediate separate sealing members present. In this embodiment, the fluid flow into the cavity exits through the one outlet orifice of the jet device. As such, if there is a small amount of leakage through any inlet, this fluid will be carried through to the outlet. Thus, leakage which may cause dripping from the head is minimized. Generally, the design of the control plate 134 and manifold plate 136 interface is designed to control the fluid flow over a large range, thereby allowing the desired flow patterns to be achieved under a wide range of flow and pressure conditions by merely by slightly repositioning the control plate. Many of the flow patterns shown in FIG. 9 are dependent upon controlling fluid flow to one or more of the inlets. It should be remarked that in other cases, it may be desirable to incorporate a secondary sealing member to more closely control leakage (shown in other embodiments). By doing so, objectionable leakage from outlets that are not being used may be avoided.

FIG. 9 illustrates a schematic view of a variety of flow patterns generated by the disclosed embodiments of the fluid spray control device. Depicted as FIGS. 9A through 9G, subtle variations to the amount of flow and orientation of flow into the jet cavity result in large variation to the effluent spray of the device. For example, when a small uniform axial flow of water is introduced in FIG. 9A, a straight effluent jet is produced, but when non-uniform axial flow of water is introduced as in FIG. 9B, the trajectory of the effluent jet is affected. A central axial flow of water introduced in FIGS. 9C and 9E, produces an oscillating/massaging jet due to the interaction of the jet cavity geometry, and the introduction of a small tangential flow to the central jet (FIG. 9D) produces a swirling effluent jet. By increasing the amount of tangential flow to center axial flow, a full cone spray is produced (FIG. 9F), and as all flow is directed tangentially, a hollow cone spray is produced (FIG. 9G). Thus, with the geometry of the disclosed jet cavity, small and subtle variations to the spray pattern may be affected with small variations to the flow properties of the influent jets while providing a desired value of droplet size, frequency and velocity that efficiently utilizes a limited amount of water available for each spray control device.

As described above, is has been shown that different flow patterns are exhibited depending upon the proportion of flows between the center jet 127 and tangential flow lateral jet 129. With a very small proportion of tangential flow, the outlet jet will typically exhibit the random jet oscillation shown in FIG. 9C. This type of performance is achieved when the tangential inlet flow is typically 5-15% as large as the center jet flow. However, it should be remarked that this ratio could vary depending upon the geometry and flow rates of the device.

As the tangential flow rate is increased, the outlet jet can be observed to oscillate in a more rapid rate. This flow behavior then progresses into a jet that periodically precesses about the center axis. Initially, the frequency at which the jet precesses appears somewhat a periodic, but as the inlet flow increases, the frequency becomes more periodic. This behavior is depicted as FIG. 9D. As the tangential flow rate increases, so does the rate of precession of the jet which also increases the intensity of the jet impact upon the surface it strikes. Because of the intensity and frequency of the impact of this jet, the behavior is analogous to that produced by shower products with moving parts like a rotating spinner (i.e., massaging shower heads). This performance is depicted as FIG. 9E and is described as a massaging jet.

As flows are being adjusted by the action of the control plate 134, the precessing jet can reverse direction and precess in the opposite direction. This means that a jet normally precessing in a clockwise direction can be observed to change direction and begin precessing in a counter clock-wise direction. The types of performance exhibited by this precessing jet occur when the proportion of tangential flow is between about 10 to 35% of the center jet flow. Again, it should be pointed out that this ratio of flows could be altered depending upon the geometry and flow rates of the particular embodiment.

Figure 9A:
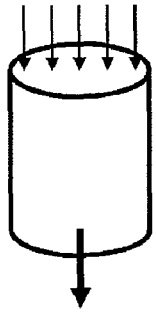
FIG. 9 illustrates a schematic view of a variety of flow patterns generated by the disclosed embodiments of the fluid spray control device.
Figure 9B:
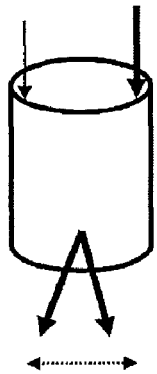
Figure 9C:
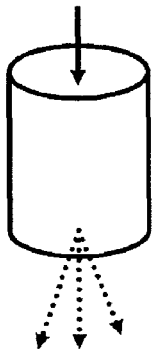
Figure 9D:
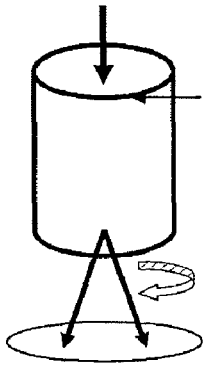
Figure 9E:
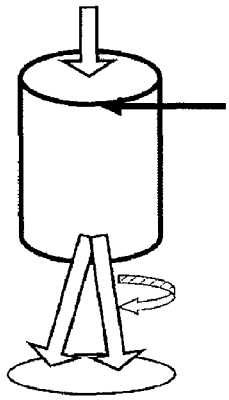
Figure 9F:
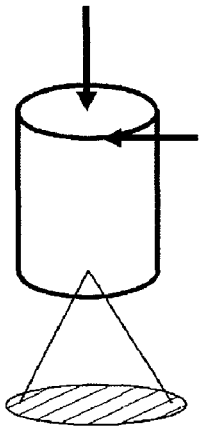

With further increase in tangential flow, the jet appears to precess at such a rapid rate, that the individual pulses become difficult to detect, as sensed for example by a hand placed at the impact point of the jet. In this case, the spray pattern now changes to a roughly conically shaped spray with the center of the cone being filled with fluid droplets. This performance is depicted in FIG. 9F. The intensity of this spray can vary depending upon the diameter of the jet cavity outlet orifice 100 and the flow rate through this outlet. As described previously, these parameters may be varied to create a very forceful feeling spray which creates the sensation that more fluid is flowing than is actually being delivered. Generally, this flow condition has been observed to occur when the proportion of the tangential inlet flow is about 25-50% that of the center jet flow.

Figure 9G:
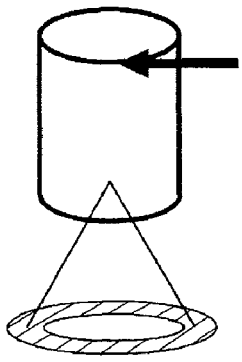

As the proportion of the center jet flow increases even further, the spray pattern becomes one in which the amount of fluid in the central portion of the cone decreases, and the spray pattern becomes "hollow" or somewhat devoid of fluid in its central area and is depicted in FIG. 9G. It should be noted, that the proportion of control flows for the above described flow patterns has been described in flow ranges, which may typically contain overlap. As explained previously, this is in part due to the fact that different geometries and flow rates can result in differing flow behaviors being observed. Additionally, it is often difficult to distinguish where one spray pattern ceases and another begins.

Since the jets of water can be controlled and modified before exiting from their respective orifices, the effluent jets can be made to travel in well defined and predictable trajectories with the result that when the droplets are formed from the issuing jets, the distribution of the droplets can be controlled over very small or very large areas. The issuing jets can exhibit these varying patterns, such as randomly oscillating jets, swirling jets with controllable swirl frequencies, extremely coherent jets, jets with full cone droplet distributions and jets with a conical sheet of droplets. Additionally, no moving parts are necessary in the jet cavity 104 or multi-cavity 126 (e.g., turbines, flaps, oscillating members etc.) to produce the variation in the spray patterns making the design simple, cost effective and easy to manufacture.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The embodiments of the invention in which an exclusive property or privilege is claimed are defined as follows:

1. A fluid spray control device that produces a variety of fluid spray patterns comprising:

a housing that forms an enclosed flow path interface between a pressurized fluid source and at least one substantially cylindrical mixing cavity, said mixing cavity having a cylindrical axis and a length which is greater than diameter;

a manifold within said housing that divides said fluid into at least two fluid streams that flow to at least one mixing cavity;

a central flow port and at least one lateral flow port positioned on a proximal end of said at least one said mixing cavity, said central flow port that jets a first portion of said divided fluid into said mixing cavity at a trajectory substantially parallel to said cylindrical axis, and said at least one lateral flow port that jets a second portion of said divided fluid into said mixing cavity at a substantially tangential trajectory to said cylindrical axis;

a control plate that interfaces with said manifold to regulate the amount of said fluid delivered to said central flow port and said at least one lateral flow port thereby regulating the ratio of said fluid delivered to said central flow port to said fluid delivered to said at least one lateral flow port during flow of said fluid spray;

a cavity outlet orifice positioned approximately on said cylindrical axis of said mixing cavity that dispenses a mixture of said first portion of said fluid and said second portion of said fluid in a flow pattern which is defined by the ratio of said first fluid introduced to said mixing cavity to said second fluid introduced to said mixing cavity, said cavity outlet orifice having an opening which is less than said mixing cavity diameter; and, a reducing section within said mixing cavity that transitions said diameter of said mixing cavity to said diameter of said cavity outlet orifice.

2. The fluid spray control device of claim 1 wherein said at least one substantially cylindrical mixing cavity is adjustable in angle with respect to said housing.

3. The fluid spray control device of claim 1 wherein said manifold divides said fluid into a plurality of substantially cylindrical mixing cavities.

4. The fluid spray control device of claim 3 wherein an orientation of said cylindrical axis of said at least one substantially cylindrical mixing cavity is adjustable in angle with respect to said housing.

5. The fluid spray control device of claim 1 wherein:

said central flow port is positioned substantially on said cylindrical axis on said proximal end, and a plurality of said lateral flow ports are positioned on said proximal end of said at least one mixing cavity.

6. The fluid spray control device of claim 1 further comprising:

at least one bypass jet that allows flow from said fluid source and dispenses said fluid that does not enter any said mixing cavity.

7. A method of producing a variety of fluid spray patterns that issue from a jet orifice comprising:

separating a fluid stream into a first fluid and a second fluid with a manifold;

introducing said first fluid under pressure to at least one central flow port on a proximal end of a substantially cylindrical mixing cavity, said mixing cavity having a cylindrical axis and a length which is greater than diameter;

jetting said first fluid in a substantially parallel trajectory to said cylindrical axis into said mixing cavity;

introducing said second fluid under pressure to at least one lateral flow port on a proximal end of said mixing cavity;

jetting said second fluid in a substantially tangential trajectory to said cylindrical axis into said mixing cavity;

mixing the flow of said first fluid with said second fluid along a length of said mixing cavity;

concentrating the flow of said mixed fluid in a section of said mixing chamber where said diameter is reduced; and, dispensing said reduced mixed fluid from said jet orifice located approximately on said cylindrical axis at a distal end of said mixing cavity;

varying the pattern of dispensed said mixed fluid by adjusting the interface between a control plate and said manifold thereby regulating the ratio of said first fluid introduced to said mixing cavity to said second fluid introduced to said mixing cavity.

8. The method of claim 7 further comprising the step of:

introducing said first fluid under pressure and said second fluid under pressure to a plurality of said mixing cavities.

9. The method of claim 8 further comprising the step of:

adjusting a trajectory angle of said at least one mixing cavity with respect to another said mixing cavity within said plurality of said mixing cavities.

10. The method of claim 7 further comprising the steps of:

bypassing said mixing cavity with said first fluid or said second fluid to create a bypass fluid;

dispensing said bypass fluid from at least one bypass jet.

11. The method of claim 10 further comprising the steps of:

regulating the flow of said first fluid delivered to said central flow port, said second fluid delivered to at least one said lateral flow port and said bypass fluid delivered to at least one bypass jet with said control plate.

12. A fluid spray control device that produces a variety of fluid spray patterns that issue from a jet orifice comprising:

a means for introducing a first fluid under pressure to at least one central flow port on a proximal end of a substantially cylindrical mixing cavity, said mixing cavity having a cylindrical axis and a length which is greater than diameter;

a means for jetting said first fluid in a substantially parallel trajectory to said cylindrical axis into said mixing cavity;

a means for introducing a second fluid under pressure to at least one lateral flow port on a proximal end of said mixing cavity;

a means for jetting said second fluid in a substantially tangential trajectory to said cylindrical axis into said mixing cavity;

a means for mixing the flow of said first fluid with said second fluid along a length of said mixing cavity;

a means for concentrating the flow of said mixed fluid in a section of said mixing chamber where said diameter is reduced; and, a means for dispensing said reduced mixed fluid from said jet orifice located approximately on said cylindrical axis at a distal end of said mixing cavity;

a means regulating the ratio of said first fluid introduced to said mixing cavity to said second fluid introduced to said mixing cavity to vary the pattern of dispensed said mixed fluid.

* * * * *